US009580153B2

(12) United States Patent
Lane

(10) Patent No.: US 9,580,153 B2
(45) Date of Patent: Feb. 28, 2017

(54) RETRACTABLE LNG CARGO TRANSFER BOW MANIFOLD FOR TANDEM MARINE CARGO TRANSFERS

(71) Applicant: Excelerate Energy Limited Partnership, The Woodlands, TX (US)

(72) Inventor: Mark K. Lane, Key Largo, FL (US)

(73) Assignee: Excelerate Energy Limited Partnership, The Woodlands, TX (US)

( * ) Notice: Subject to any disclaimer, the term of this patent is extended or adjusted under 35 U.S.C. 154(b) by 0 days.

(21) Appl. No.: 15/117,832

(22) PCT Filed: Feb. 24, 2015

(86) PCT No.: PCT/US2015/017369
§ 371 (c)(1),
(2) Date: Aug. 10, 2016

(87) PCT Pub. No.: WO2015/130701
PCT Pub. Date: Sep. 3, 2015

(65) Prior Publication Data

US 2016/0362163 A1 Dec. 15, 2016

Related U.S. Application Data

(60) Provisional application No. 61/944,186, filed on Feb. 25, 2014.

(51) Int. Cl.
*B63B 27/34* (2006.01)
*B63B 27/25* (2006.01)
*B67D 9/00* (2010.01)

(52) U.S. Cl.
CPC ..... *B63B 27/34* (2013.01); *B63B 27/25* (2013.01); *B67D 9/00* (2013.01); *B63B 2734/00* (2013.01)

(58) Field of Classification Search
CPC ..... B63B 27/34; B63B 27/25; B63B 2734/00; B67D 9/00
(Continued)

(56) References Cited

U.S. PATENT DOCUMENTS 4,408,943 A 10/1983 McTamaney et al.
8,104,417 B1 * 1/2012 Shivers, III ..... B63B 27/24 114/230.14
(Continued)

FOREIGN PATENT DOCUMENTS

WO 2013-064601 A1 5/2013

OTHER PUBLICATIONS

Korean Intellectual Property Office, International Search Report for PCT Application No. PCT/US2015/017369, mailed Jun. 1, 2015, 3 pages.
(Continued)

*Primary Examiner* — Nicolas A Arnett
(74) *Attorney, Agent, or Firm* — Frederic Dorwart, Lawyers; Penina Michlin Chiu

(57) ABSTRACT

An apparatus, system and method for a retractable LNG cargo transfer bow manifold for tandem marine cargo transfers are described herein. A retractable liquefied natural gas (LNG) cargo transfer system comprises a marine vessel, an LNG cargo transfer bow manifold moveably attached to a main deck of the marl He vessel, wherein the LNG cargo transfer bow manifold is slideable between a forward position proximate a bow of the marine vessel, and an aft position aft of the bow, the LNG cargo transfer bow manifold elevationally coupled to the main deck by a retractable support member, wherein the retractable support member is moveable between an extended position such that the LNG cargo transfer bow manifold is raised above the main deck, and a retracted position such that the LNG cargo transfer
(Continued)

bow manifold rests on one of the main deck, below the main deck or a combination thereof.

19 Claims, 6 Drawing Sheets

(58) Field of Classification Search
USPC ..... 114/230.15–230.17; 141/1, 231, 387; 441/4
See application file for complete search history.

(56) References Cited

U.S. PATENT DOCUMENTS

| | | | | |
|---|---|---|---|---|
| 8,308,517 | B1 * | 11/2012 | Shivers, III | B63B 21/50 114/230.14 |
| 8,308,518 | B1 * | 11/2012 | Shivers, III | B63B 21/50 114/230.14 |
| 2010/0263389 | A1 | 10/2010 | Bryngelson et al. | |
| 2012/0230772 | A1 | 9/2012 | Foo et al. | |
| 2013/0340668 | A1 | 12/2013 | Robertson | |
| 2016/0146385 | A1 * | 5/2016 | Bryngelson | F16L 37/002 285/1 |

OTHER PUBLICATIONS

Korean Intellectual Property Office, "Written Opinion of the International Searching Authority" for PCT Application No. PCT/US2015/017369, mailed Jun. 1, 2015, 4 pages.

* cited by examiner

RETRACTABLE LNG CARGO TRANSFER BOW MANIFOLD FOR TANDEM MARINE CARGO TRANSFERS

BACKGROUND

1. Field of the Invention

Embodiments of the invention described herein pertain to the field of marine transfer of liquefied natural gas ("LNG") between vessels. More particularly, but not by way of limitation, one or more embodiments of the invention enable an apparatus, system and method for a retractable LNG cargo transfer bow manifold for tandem marine cargo transfers.

2. Description of the Related Art

Natural gas is often carried in liquefied form onboard special cryogenic tanker ships from the location of its origin to the location of consumption. In this way, natural gas may be transported to areas with a higher demand for natural gas. Since liquefied natural gas (LNG) occupies only about 1/600th of the volume that the same amount of natural gas does in its gaseous state, liquefying the natural gas for transport facilitates the transportation process and improves the economics of the system. LNG is produced in onshore or offshore liquefaction plants by cooling natural gas below its boiling point (−259° F. at ambient pressures). The LNG may be stored in cryogenic containers either at or slightly above atmospheric pressure. Typically the LNG will be regasified prior to distribution to end users.

In some instances, a mobile vessel is loaded with LNG cargoes at the natural gas supply source and travels across the ocean to another location for offloading and distribution. Increasingly, an LNG carrier (LNGC) or vessel with regasification facilities is loaded with LNG cargo at a location between the port of origin and the port of consumption using ship-to-ship (STS) transfer of LNG. In one example, a conventional LNGC collects the LNG from the liquefaction plant at the natural gas supply source or other LNG loading location and is used for the long haul or a portion of the transportation route. The conventional LNGC delivers the cargos from the supply source to the STS transfer location. In this example, a regasification vessel receives the cargo from the LNGC and may be used in shuttle service between the STS transfer location and the offloading port. In yet another example, a conventional LNGC berths alongside a floating platform for the regasification of LNG onboard the floating platform, and the floating platform is attached to a riser or jetty. In such scenarios, STS transfer is used to load LNG onto the floating platform.

In order to implement the STS transfer of LNG, it is often advantageous to use a tandem loading configuration, in which the stern of one of the vessels faces the bow of the other vessel, as illustrated in FIG. 1. The actual STS transfer of the LNG may be either from or toward the vessel astern of the other. In FIG. 1, loading device 100 is shown on conventional loading deck 110 on conventional receiving vessel 130. The raised position of loading device 100 is permanent and allows conventional LNG cargo transfer hose(s) 115 or articulated pipeline (arms) to remain in a stable catenary/apex configuration, and also provides for conventional disconnect coupler 120. Conventional disconnect coupler(s) 120 allows tor immediate separation of supply vessel 125 and receiving vessel 130 in the event of an emergency during an STS transfer operation. In such circumstances, the flow of LNG ceases, and the conventional transfer hoses 115 be disconnected from the supply 125 and/or receiving vessel 130 at the conventional disconnect coupling 120.

Vessels, including LNGCs and offshore floating platforms, must be capable of withstanding severe weather conditions, such as storms, high wind and hurricanes. During extreme weather conditions, it may not be possible or desirable to move a floating LNG production vessel to a protected location due to moorings, gas risers, and/or pipeline and well controls, and so the vessel may experience heavy loads from large waves beating down on the deck of the vessel. In the case of the transporting LNGC the effects of ocean, wind and wave systems during significant storm events during a passage, may physically damage a fixed bow loading or fixed bow unloading unit to the extent it is no longer safe to use at the next loading or disport facility. Strong or continuous wave forces on decks can cause damage to the vessel and equipment on board, and the deck may be flooded with green water (a compact mass of water flowing across the deck of the vessel).

To combat damage during extreme weather conditions, oil bow loading units are typically robust manifold systems capable of weathering stormy seas. However, unlike oil, LNG is cryogenic. For LNG transfer tandem configurations, the transfer systems are not as robust in size and mass and are therefore subject to damage not typically sustained by oil units. Unlike oil loading/offloading devices, these LNG handling systems may include particularly fragile process instrumentation, emergency shutdown systems and/or quick connect/disconnect couplers which are a required design component in order to meet safely standards (e.g., ISO DTR 17177, ISGOTT, SIGTTO STS Transfer Guide). Thus, fixing the LNG loading/offloading device on the bow of the LNGC during travel risks significant damage to the loading and unloading units.

Conventional LNG bow loading and conventional LNG bow unloading units currently used onboard LNG vessels are not well suited to withstand extreme weather conditions. Therefore, there is a need for a retractable LNG cargo transfer bow manifold for tandem marine cargo transfers.

SUMMARY

Embodiments described herein generally relate to an apparatus, system and method for a retractable LNG cargo transfer bow manifold for tandem marine cargo transfers. A retractable LNG cargo transfer bow manifold for tandem marine cargo transfers is described.

An illustrative embodiment of a retractable liquefied natural gas (LNG) cargo transfer system comprises a marine vessel, an LNG cargo transfer bow manifold moveably attached to a main deck of the marine vessel, wherein the LNG cargo transfer bow manifold is slideable between a forward position proximate a bow of the marine vessel, and an aft position aft of the bow, the LNG cargo transfer bow manifold elevationally coupled to the main deck by a retractable support member, wherein the retractable support member is moveable between an extended position such that the LNG cargo transfer bow manifold is raised above the main deck, and a retracted position such that the LNG cargo transfer bow manifold rests on one of the main deck, below the main deck or a combination thereof, wherein the forward position, together with the extended position, arranges the LNG cargo transfer bow manifold into a cargo transfer position, and wherein the aft position, together with the retracted position, arranges the LNG cargo transfer bow manifold into a stowed position. In some embodiments, the LNG cargo transfer bow manifold further comprises a removable cargo transfer conduit fluidly coupling the marine vessel and a second marine vessel when the LNG cargo transfer bow manifold is in the cargo transfer position. In certain embodiments, the LNG cargo transfer bow manifold further comprises detachable piping fluidly coupling the LNG cargo transfer bow manifold to an LNG cargo tank onboard the marine vessel when the LNG cargo transfer bow manifold is in the cargo transfer position. In some embodiments, the cargo transfer conduit and the piping are disconnected from the LNG cargo transfer bow manifold when the LNG cargo transfer bow manifold is in the stowed position. In some embodiments the system further comprises a manifold deck coupled between the retractable support member and the LNG cargo transfer bow manifold. In certain embodiments the system further comprises an actuateable barrier, wherein the actuateable barrier closes the LNG cargo transfer bow manifold in the stowed position.

An illustrative embodiment of a method for tandem marine liquefied natural gas (LNG) cargo transfers comprises positioning a first marine vessel at a ship to ship (STS) transfer location in tandem with a second marine vessel, sliding an LNG cargo transfer bow manifold onboard the first marine vessel forward along a track to about a bow of the first marine vessel, extending an LNG cargo transfer bow manifold support member to bring the LNG cargo transfer bow manifold above a main deck of the first marine vessel, coupling an LNG transfer conduit to the LNG cargo transfer bow manifold on a first side and to the second marine vessel on a second side at the STS transfer location, connecting LNG piping to the LNG cargo transfer bow manifold on a first coupled side of the LNG piping and an LNG cargo tank onboard the first marine vessel on a second coupled side of the LNG piping at the STS transfer location, transferring LNG between the first marine vessel and the second marine vessel using the LNG cargo transfer bow manifold, and returning the LNG cargo transfer bow manifold to a protected position onboard the first marine vessel prior to departing the STS transfer location. In some embodiments, returning the LNG cargo transfer bow manifold to a protected position comprises disconnecting the LNG piping from the LNG cargo transfer bow manifold and the LNG cargo tank, sliding the LNG cargo transfer bow manifold aft along a track away from the bow of the first marine vessel, and retracting an LNG cargo transfer bow manifold support member to bring the LNG cargo transfer bow manifold onto the main deck of the first marine vessel. In certain embodiments, extending the LNG cargo transfer bow manifold support member comprises raising the LNG cargo transfer bow manifold over a breakwater.

An illustrative embodiment of a liquefied natural gas (LNG) cargo transfer system comprises a first LNG carrier vessel comprising a protected location within a hull of the first LNG carrier vessel and below a main deck, an LNG cargo transfer bow manifold slideably coupled to the protected location, wherein the LNG cargo transfer bow manifold is slideable between a protected position at the protected location, and an LNG transfer position forward of a bow of the marine vessel and at least partially outside the hull, an actuateable shield at the bow, wherein the actuateable shield closes the protected location when the LNG cargo transfer bow manifold is in the protected position and opens to allow the LNG cargo transfer bow manifold to slide to the LNG transfer position, and a removable LNG transfer conduit fluidly coupling the first LNG carrier vessel and a second LNG carrier vessel when the LNG cargo transfer bow manifold is in the LNG transfer position, and detachable piping fluidly coupling the LNG cargo transfer bow manifold to an LNG cargo tank onboard the first LNG carrier vessel when the LNG cargo transfer bow manifold is in the LNG transfer position.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
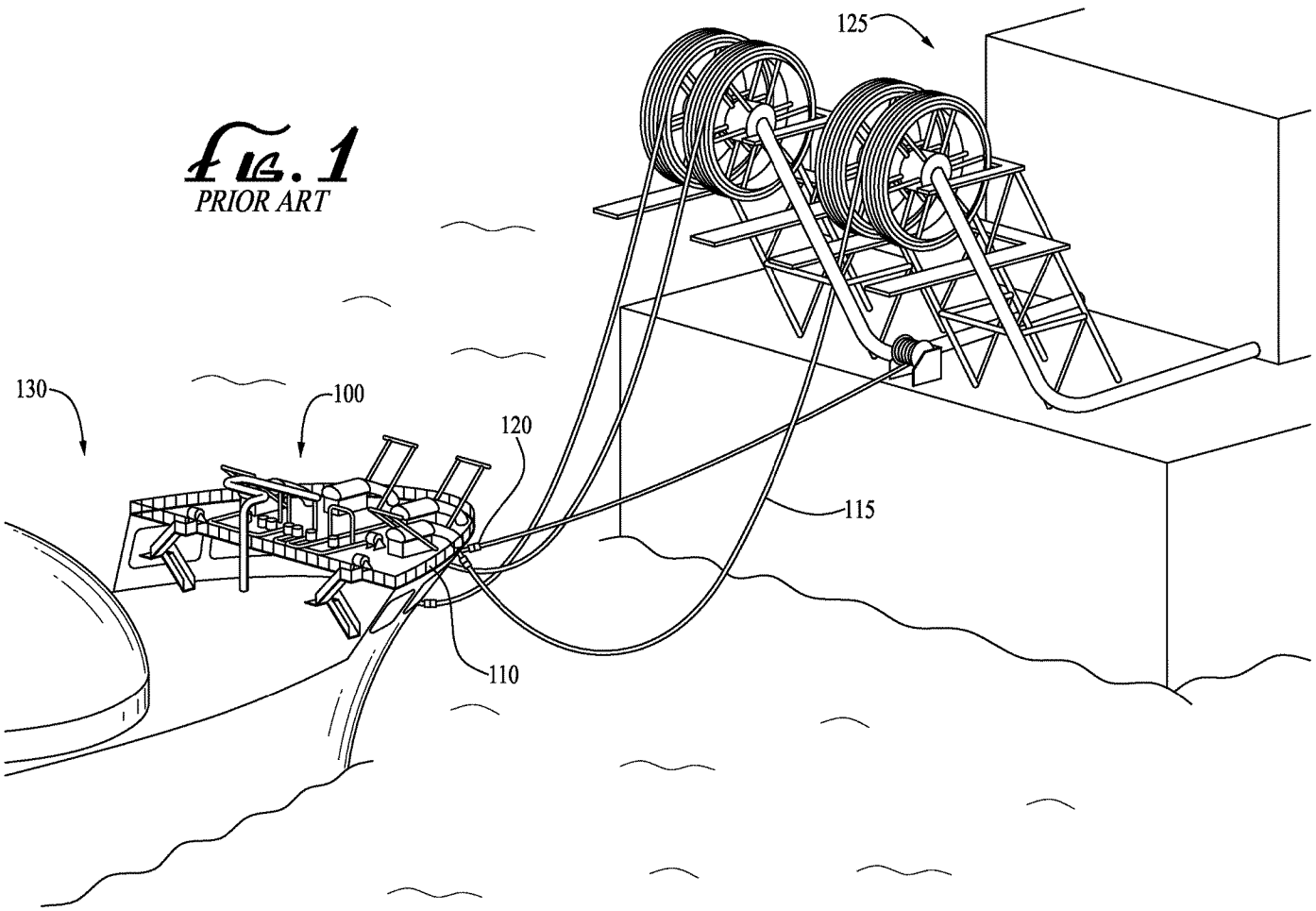
Fig. 1 PRIOR ART
FIG. 1 is a perspective view of a tandem LNG transfer configuration of the prior art.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

A retractable LNG cargo transfer bow manifold for tandem marine cargo transfers will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a hose includes one or more hoses.

"Coupled" refers to either as direct connection or an indirect connection (e.g., at least one intervening connection) between one or more objects or components. The phrase "directly attached" means a direct connection between objects or components.

While for illustration purposes the invention is described in terms of liquefied natural gas, nothing herein is intended to limit the invention to that embodiment. The invention may be equally applicable to other gases which may be transported as cryogenic liquids, for example, ethane, ethylene, ammonia or vinyl chloride.

A retractable LNG cargo transfer bow manifold for tandem marine cargo transfers is described herein. Using the apparatus, systems and methods described herein a bow loading and/or unloading manifold may remain protected from shipping seas during severe weather, and/or the shipping of green water may be avoided. Illustrative embodiments may assist in ensuring the LNG transfer system, with its unique and delicate components (process instrumentation, ESD system, etc.) may be available for use and not destroyed by heavy weather sea states. An LNG cargo transfer bow manifold, which may be a loading or unloading manifold on an LNG supply or receiving vessel, may actuate aft from the bow to avoid exposure to waves or weather while the vessel is steaming at sea (or otherwise not in the course of LNG transfer operations), and move forward towards the bow for LNG transfer (loading or unloading) operations. In some embodiments, the LNG cargo transfer bow manifold may retract aft of a vessel bow, down onto a deck and or into the hull when the manifold is not in use, for example during travel and/or inclement weather. In some embodiments, a door, shield and/or breakwater may further protect the LNG cargo transfer bow manifold from damage.

Vessel 200 may be a LNG carrier, regasification vessel, barge or other floating unit or vessel configured to transport cryogenic liquids through navigable waterways, for example an ethane carrier. In embodiments where vessel 200 is a regasification vessel, vessel 200 is equipped with vaporizers onboard to vaporize (regasify) cargoes prior to delivery at a destination. In certain embodiments, vessel 200 may be a floating storage and regasification unit or a floating liquefaction storage and offloading unit. Retractable manifold 210 may be an LNG cargo transfer bow manifold for tandem cargo transfers. In other embodiments, retractable manifold 210 may be an LNG cargo transfer stern manifold for tandem cargo transfers. Vessel 200 and retractable manifold 210 may function in both a loading and unloading capacity. In one example, vessel 200 may employ retractable manifold 210 to receive LNG from a floating liquefaction unit, travel with the obtained cargo to an offloading destination, and then subsequently employ retractable manifold 210 to offload the LNG cargo onto a floating regasification unit by way of a tandem ship-to-ship (STS) cargo transfer. In such an example, retractable manifold 210 be in a transfer position during receipt of the cargo, placed into and secured in an at-sea, protected position during travel, and then repositioned into the transfer position during offloading of the cargo.

Figure 2A:
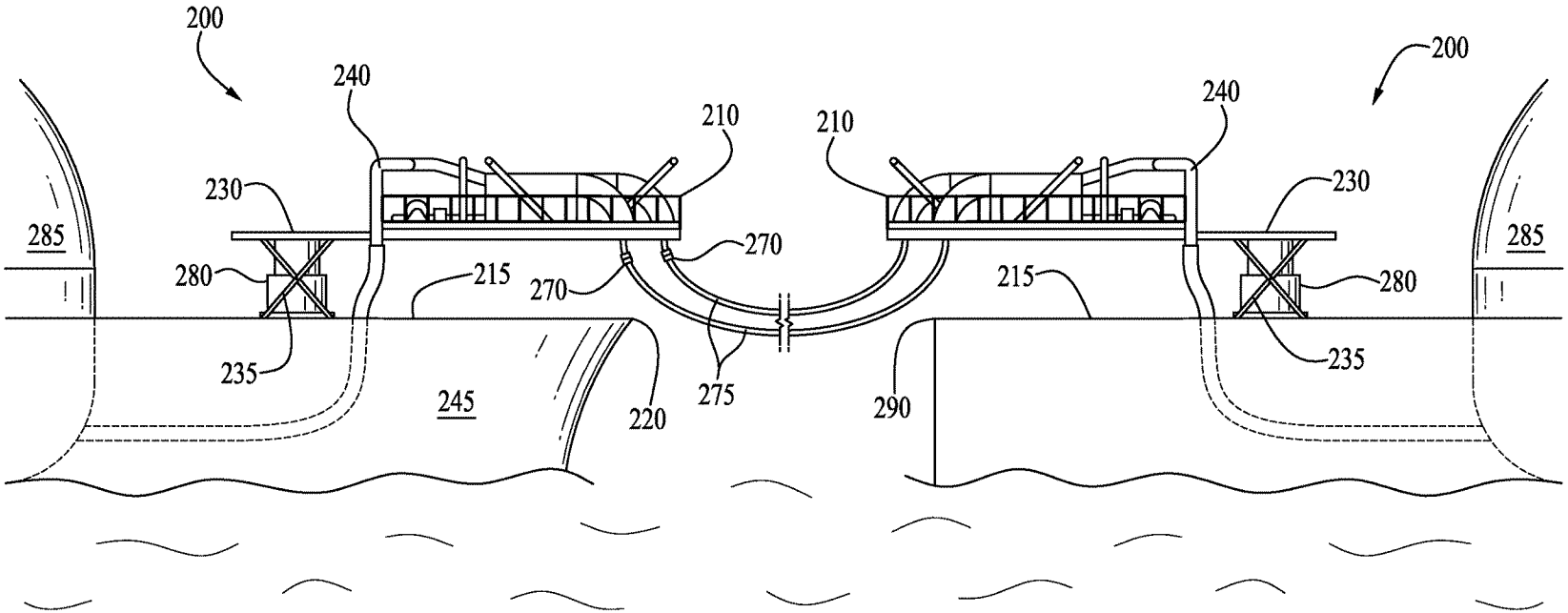
FIG. 2A is a perspective view of an illustrative embodiment of a retractable LNG cargo transfer bow manifold in a transfer position.

Components of loading and unloading manifolds for the tandem STS transfer of LNG and other liquefied gases are well-known to those of skill in the art and are therefore not described in detail herein so as not to obscure the invention. LNG cargo transfer manifolds are based upon industry standards for design, function, size, compatibility with a wide range of terminal facilities, emergency response and mitigation features, for example as described in SIGTTO's Manifold Recommendations for Liquefied Gas Carriers. STS transfer operations using the tandem configuration may occur in open water, near a jetty or port, or whilst vessel 200 is moored at a jetty or single-point moored. Vessel 200 may be a supply and/or receiving vessel and may be at anchor, single-point moored, moored to a jetty, moored to the other vessel engaged in the transfer operations and/or may be travelling in the same direction as the other vessel (sending or receiving as the case may be) during transfer operations. FIG. 2A is an illustrative embodiment of a retractable LNG cargo transfer bow manifold transfer system in a transfer position. In FIG. 2A, two vessels 200 are both shown in a transfer position: one is a supply vessel supplying LNG and the other is a receiving vessel receiving LNG. For purposes of the example shown in FIG. 2A, the two vessels 200 are interchangeable, since as shown in FIG. 2A, both vessels 200 make use of retractable manifold 210 of illustrative embodiments. However, it is not a limitation of the invention that both vessels 200 make use of the invention described herein. In illustrative embodiments, one of the supply vessel, the receiving vessel or both of the supply vessel and the receiving vessel may make use of retractable manifold 210 of illustrative embodiments. The marine vessels 200 of FIG. 2A are in a tandem transfer configuration, with bow 220 of first vessel 200 facing stern 290 of second vessel 200, and the transfer of LNG being between the vessels in either direction. As shown in FIG. 2A, retractable manifold 210 is in a transfer position on both vessels 200, extending out over and/or proximate bow 220 and/or stern 290 of the respective vessels 200. LNG transfer conduit 275 may fluidly connect vessels 200 and allow for the transfer of LNG between vessels 200 when retractable manifolds 210 on vessels 200 are in the transfer position.

Figure 2B:
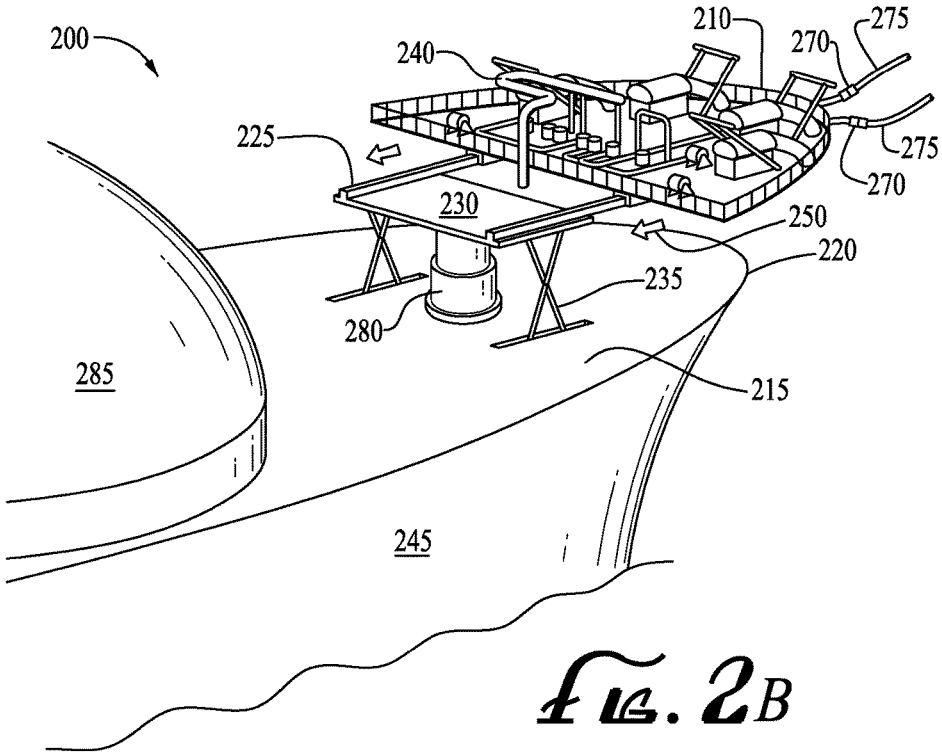
FIG. 2B is a perspective view of a retractable LNG cargo transfer bow manifold of illustrative embodiments in as transfer position and illustrating actuation of the retractable LNG cargo transfer unit aft of the bow.
Figure 2C:
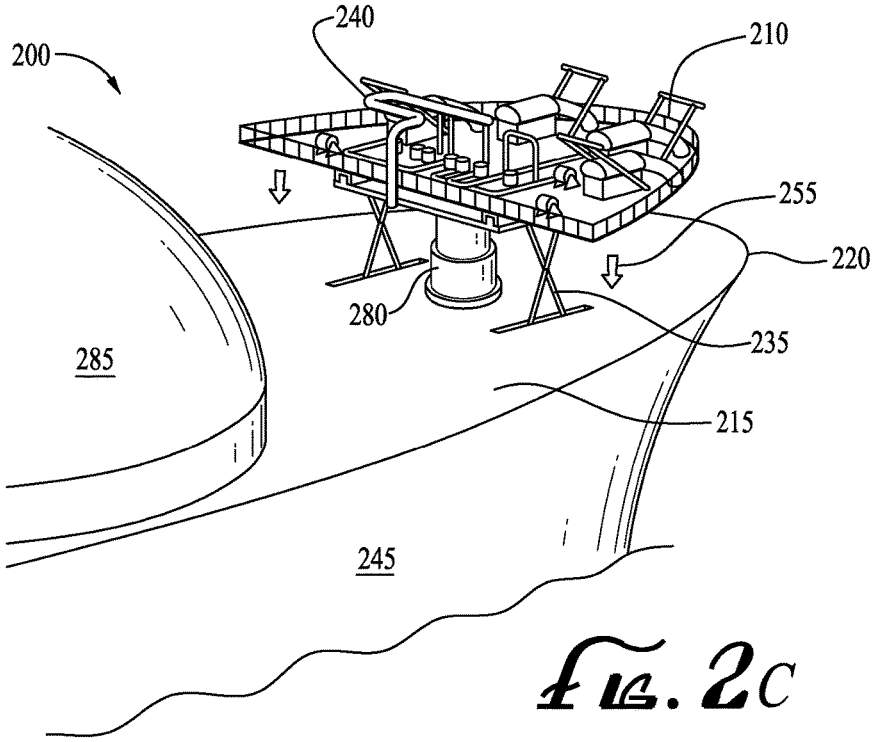
FIG. 2C is a perspective view of a retractable LNG cargo transfer bow manifold of illustrative embodiments actuating downward onto a vessel deck.
Figure 2D:
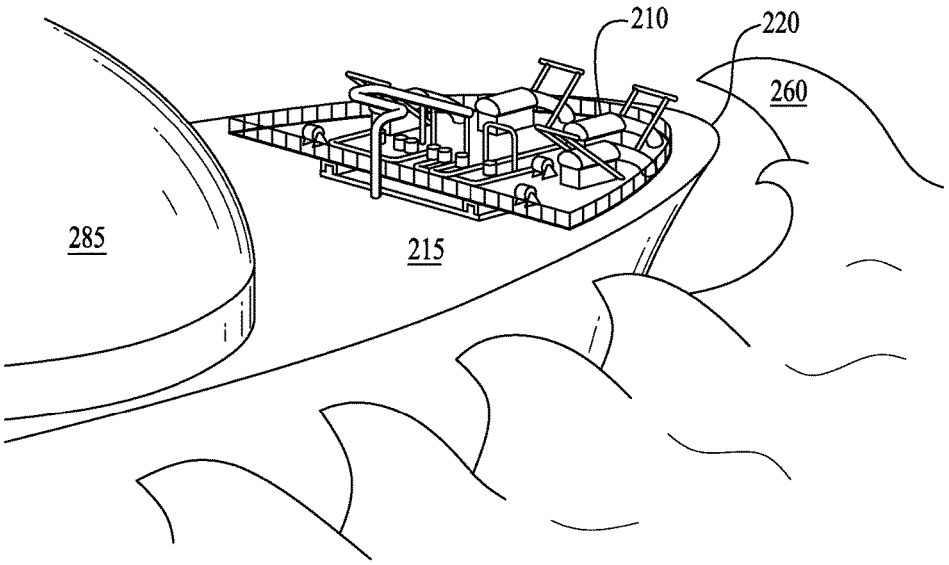
FIG. 2D is a perspective view of a retractable LNG cargo transfer bow manifold in a protected position of illustrative embodiments.

FIGS. 2B-2D illustrate a retractable LNG cargo transfer bow manifold of an illustrative embodiment. For ease of description and so as not to obscure the invention, FIGS. 2B-2D illustrate a retractable LNG cargo transfer bow manifold 210 on bow 220 of vessel 200, but as those of skill in the art will appreciate and as illustrated in FIG. 2A, illustrative embodiments may also equally be employed on stern 290. For purposes of the LNG cargo transfer bow manifold 210 described herein, the supply and receiving vessels 200 will be arranged in a tandem configuration during transfer operations.

FIG. 2B shows an illustrative embodiment of retractable manifold 210 in an LNG cargo loading or unloading position at bow 220 of vessel 200. Retractable manifold 210 may be above bow 220 or extend past bow 220 over the water when in a loading or offloading position, such that quick connect disconnect coupler 270 may be employed on LNG transfer conduit 275, which LNG transfer conduit 275 may be flexible hoses, rigid piping and/or an articulated arm. Retractable manifold 210 may rest on partial manifold deck 230, which is positioned above vessel main deck 215 in FIG. 2B. Pipe 240 may transfer LNG or another cryogenic liquid to cryogenic cargo tanks 285 onboard vessel 200, for example in hull 245 of vessel 200. Pipe 240 may be a flexible hose or articulated pipe and may connect to retractable manifold 210 only during, or in preparation for, loading or unloading operations. Similarly, pipe 240 may be disconnected from retractable manifold 210 when retractable manifold 210 is in a protected position and/or being moved into a protected position. In other embodiments, pipe 240 may have flexibility, the ability to move, pivot or stretch and/or with extra length to accommodate movement of retractable manifold 210.

Manifold deck 230 may include railings 225 or tracks configured to allow retractable manifold 210 to actuate into a cargo transfer position at, above, forward of and/or proximate to bow 220 on the one hand, and to a protected position aft of bow 220 on the other hand, as illustrated with aft arrows 250 shown in FIG. 2B. LNG transfer conduit 275 may be disconnected prior to stowing (moving) the manifold to the at-sea position (i.e., prior to actuation of retractable manifold 210 away from the transfer position and/or towards a protected position). In some embodiments, a hydraulic or pneumatic system (not shown and well known to those of skill in the art) may be employed to actuate retractable manifold 210. In one embodiment, prior to arrival of the LNG vessel to the load or disport, the crew manually or in an automated fashion may reposition the LNG cargo bow retractable manifold 210 from the stowed, at-sea position (protected position) to the cargo transfer operational position and proceed to satisfy a series of pre-transfer operational and safety checks. While LNG transfer conduit 275 and/or pipe 240 are connected to retractable manifold 210, retractable manifold 210 may function as any bow loading or offloading manifold would function, as is well known to those of skill in the art of LNG STS transfer. After completion of cargo transfer, the LNG transfer conduit 275 and/or pipe 240 may be disconnected, and the crew of vessel 200 may reposition retractable manifold 210 from the cargo transfer operational position to the stowed-at-sea position (protected position) within the protective space dedicated for this purpose, in the case of an emergency disconnection of the LNG transfer conduits 275 and/or pipe 240, the disposition of the retractable manifold 210 may be addressed once mitigating action and response to the emergency condition has been satisfied.

In addition to or instead of actuating aft of bow 220, retractable manifold 210 may actuate downwards from manifold deck 230 onto vessel deck 215 and/or manifold deck 230 itself may actuate downwards onto vessel main deck 215, as illustrated in FIG. 2C. In some embodiments, retractable manifold 210 and/or manifold deck 230 may first actuate downward towards vessel main deck 215, and then subsequently actuate aft of bow 220 along vessel main deck 215, or the ordering of actuation may be reversed. In the former instance, tracks 225 may be located on main deck 215. In certain embodiments, retractable manifold 210 may actuate aft of bow 220 and/or forward towards bow 220 on wheels, a track and/or railing 225, such as protrusion or indentations on manifold deck 230 and/or main deck 215 on which retractable manifold 210 may slide, roll and/or move into and between appropriate positions. Once situated on vessel main deck 215, when in the stowed, at-sea position, retractable manifold 210 may be both aft of bow 220 and lowered from partial manifold deck 230 in a position protected from large waves that may strike bow 220 of vessel 200 during severe weather. As shown in FIG. 2B and 2C, in some embodiments, the entirety of retractable manifold 210 and/or manifold deck 230 actuates into a protected (stowed) position.

Supports 235 and/or pillar 280 may support retractable manifold 210 and/or manifold deck 230 when in an operational transfer (raised) position. Supports 235 and/or pillar 280 may retract, telescope, collapse and/or fold onto vessel main deck 215 and/or into hull 245 to allow retractable manifold 210 and/or manifold deck 230 to rest an vessel main deck 215, as illustrated by lowering arrows 255 in FIG. 2C. In some embodiments, pillar 280 may be hollow and allow pipe 240 to carry cargo to cargo tanks 285 onboard vessel 200, for example within hull 245. FIG. 2D illustrates retractable manifold 210 in a protected (stowed, at-sea) position. As shown in FIG. 2D, retractable manifold 210 is aft of bow 220 and resting on vessel main deck 215, such that wave 260 may not reach retractable manifold 210 or there is a significantly lower probability (as compared to the transfer position) that wave 260 will reach retractable manifold 210 and potentially cause damage or green water. The location of protected position may be based on the size of vessel 200 and/or the height of reasonably anticipated waves, and should be a distance from bow 220 reasonably calculated to prevent "crashing" green seas from pummeling retractable manifold 210. Transfer (loading and/or unloading) operations may not occur while retractable manifold 210 is in a protected position, but rather transfer of cargo may be deferred until the severe weather has passed.

Figure 3:
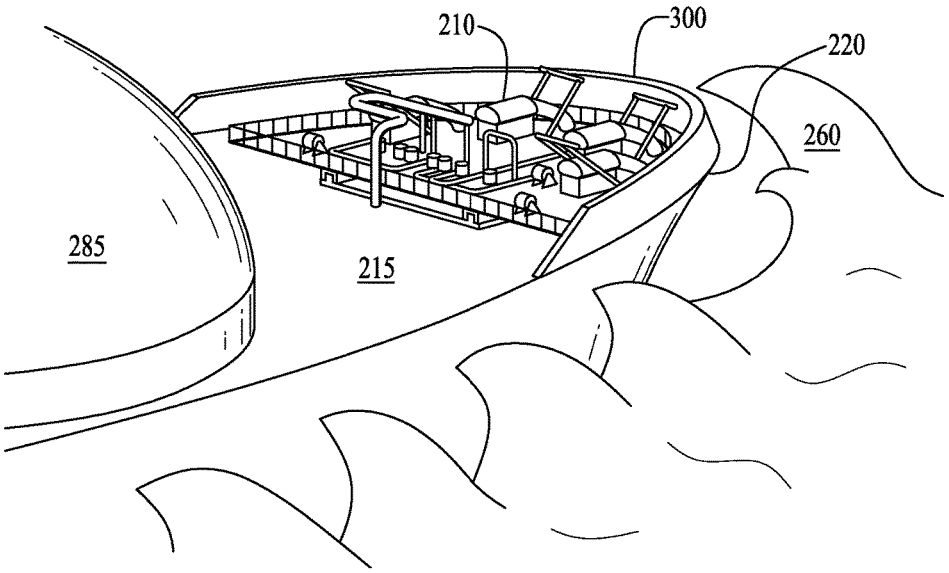
FIG. 3 is a perspective view of a breakwater protecting a retractable LNG cargo transfer bow manifold of illustrative embodiments.

FIG. 3 illustrates breakwater 300 of an illustrative embodiment protecting retractable manifold 210 when retractable manifold 210 is in a stowed position. Breakwater 300 may be removable or may be a permanent addition to bow 220. Breakwater 300 may be arranged around the periphery of bow 220, main deck 215 and/or bow manifold 210 and provide additional protection from particularly large or forceful wave 260. In instances where breakwater 300 is not removable, retractable manifold 210 may actuate above and/or over breakwater 300 when in a loading or offloading position. In some embodiments, breakwater 300 is not necessary.

Figure 4A:
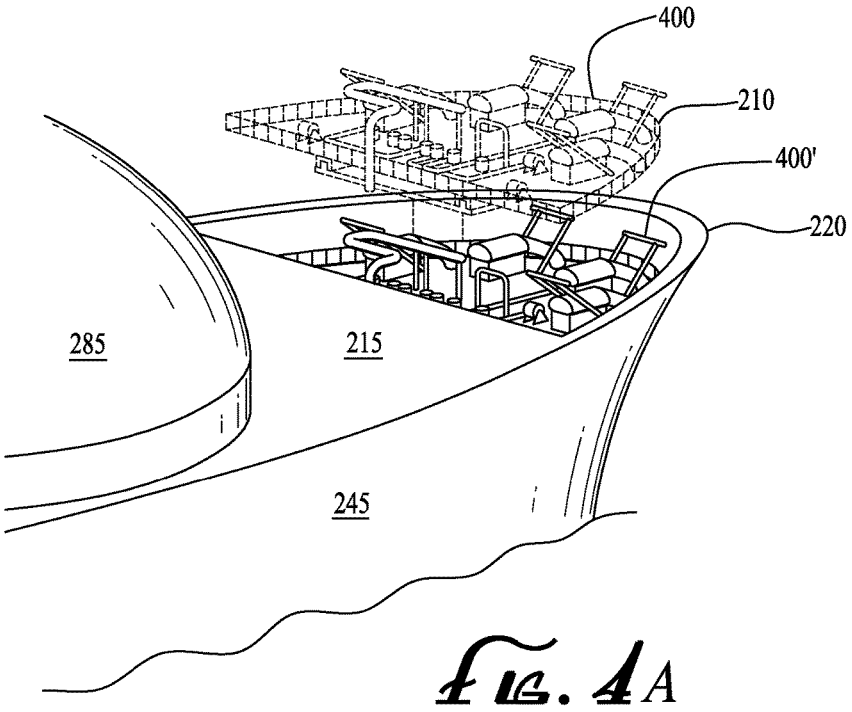
FIG. 4A is a perspective view of an illustrative embodiment of a retractable LNG cargo transfer bow manifold in a protected position within the hull and alternatively in a transfer position.
Figure 4B:
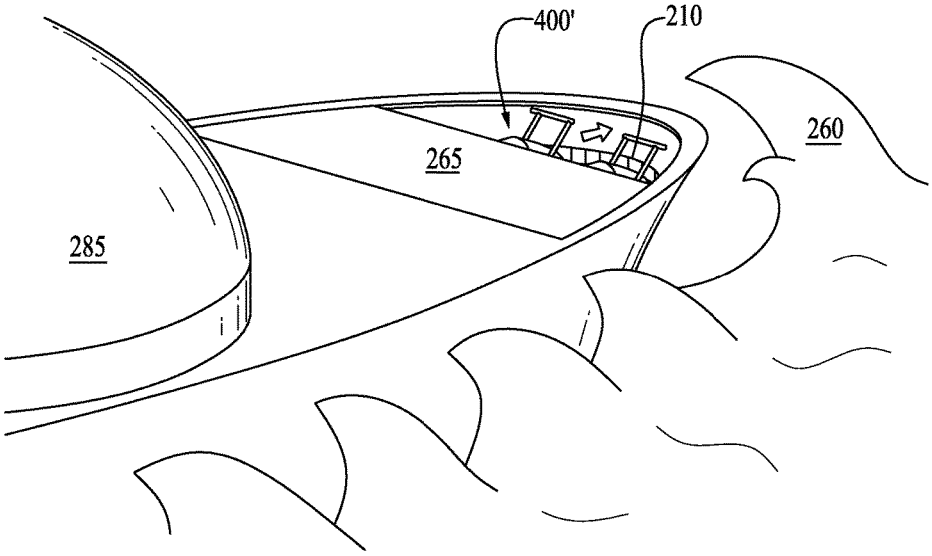
FIG. 4B is a perspective view of an illustrative embodiment of a retractable LNG cargo transfer bow manifold in a protected position within the hull.

FIGS. 4A and 4B illustrate an alternative embodiment in which retractable manifold 210 retracts not onto vessel main deck 215, but into hull 245 when in a protected, at-sea and/or stowed position. As shown in FIG. 4A, retractable manifold 210 may be in transfer position 400 or hull position 400'. Transfer position 400 may be raised above vessel main deck 215 and/or proximate bow 220. Transfer position 400 of retractable manifold 210 should be at a sufficient height above vessel main deck 215 and bow 220 bulwarks to allow a clear view of and unrestricted movement of the LNG transfer conduits 275 (shown in FIGS. 2A and 2B). Retractable bow manifold 210 is shown in protected hull position 400' in FIG. 4B. As illustrated in FIG. 4B, barrier 265 may open to allow retractable manifold 210 to actuate between transfer position 400 and hull position 400'. Barrier 265 may be a door, moveable wall, hatch or recession in vessel main deck 215 and/or built into vessel main deck 215. Once retractable manifold 210 is in protected hull position 400', barrier 265 may close over retractable manifold 210, protecting retractable manifold 210 from wave 260. Barrier 265 may be manually, hydraulically or pneumatically actuated. Local and/or remote control may be employed, along with CCTV, closed door sensors and/or interlocks necessary to prevent unauthorized operation and making to sea with the system improperly secured.

Figure 5A:
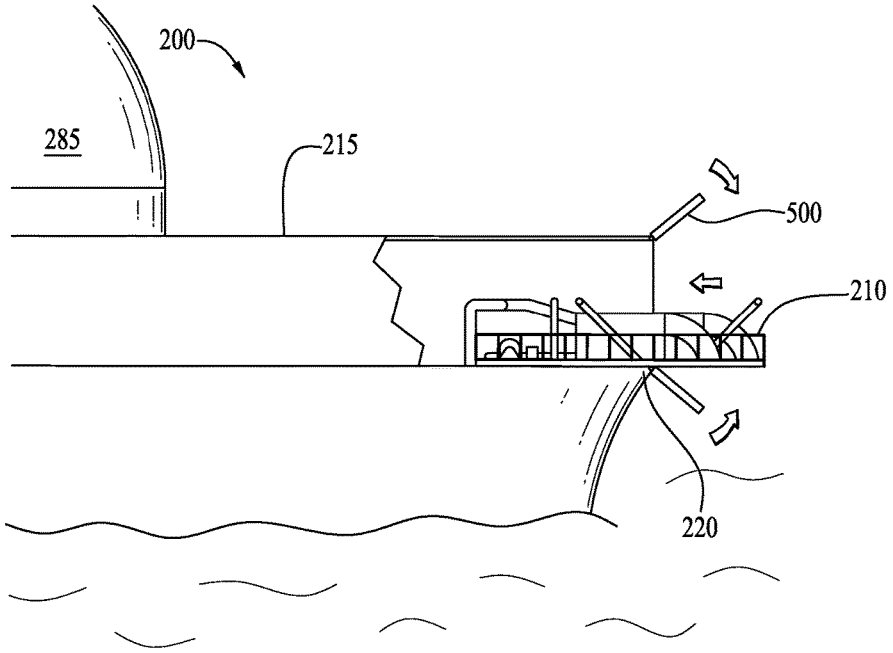
FIG. 5A is a perspective view of an illustrative embodiment of a retractable LNG cargo transfer bow manifold in an LNG transfer position in front of the bow.
Figure 5B:
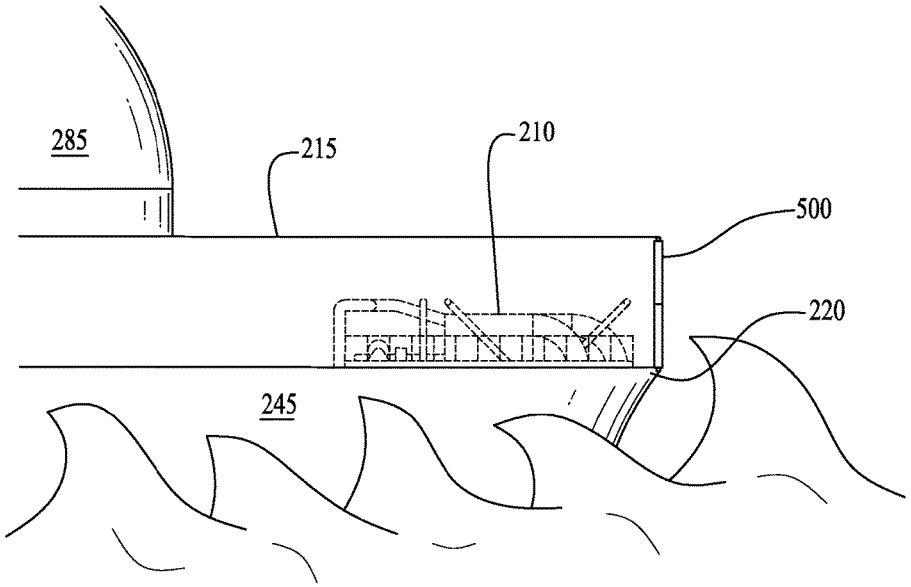
FIG. 5B is a perspective view of an illustrative embodiment of a retractable LNG cargo transfer bow manifold in a protected position within the hull.

FIGS. 5A and 5B illustrate a further embodiment of a retractable manifold. As shown in FIG. 5A, retractable manifold 210 resides below vessel main deck 215. Retractable manifold 210 may be situated in a position forward of bow 220 during loading or offloading operations, for example as illustrated in FIG. 5A. During severe weather and/or when retractable manifold 210 is not in use, retractable manifold 210 may retract inside (below main deck 215) vessel 200 and/or hull 245, for example as illustrated in FIG. 5B. Although retractable manifold 210 may actuate forward of bow 220 or aft of bow 220 and within vessel 200, there is no need for retractable manifold 210 to actuate upwards or downwards in the embodiment of FIGS. 5A and 5B. Shield 500 may be in an open position to allow retractable bow manifold 210 to actuate as shown in FIG. 5A, or may be in a closed position to protect retractable manifold 210, as shown in FIG. 5B. In some embodiments, the entirety of retractable manifold 210 may retract inside vessel 200 when not conducting transfer operations.

In most cases, due to the cargo tank 285 containment design of LNG vessels, the STS transfer of LNG should take place in a fairly benign metocean environment or the LNG vessel may be subject to sloshing cargo impacts on the walls of the cargo containment system. These impacts can and have been known to cause cargo containment failures. In all cases of when LNG vessel 200 is steaming between load and disport locations, the cargo system along with all other aspects or vessel 200 are maintained in a manner which is commonly characterized as in compliance with the practices of good seamanship. In instances of LNG vessel 200 steaming "at sea" the retractable manifold 210 may be stowed away into the protected location to prevent, in the case of severe weather where LNG vessel 200 is likely to ship green seas and/or push bow 220 underwater due to excessive wave height, damage to the system components including cryogenic valves, piping, insulation, process instrumentation, insulation and safety systems which do not exist on tankers with conventional loading or offloading units.

Thus, a retractable LNG cargo transfer bow manifold for tandem marine cargo transfers has been described herein. Illustrative embodiments provide a cargo transfer bow manifold onboard a marine vessel that is retractable into a protected position while the vessel is underway and/or not conducting transfer operations. When in the protected position, the LNG cargo transfer bow manifold may be less susceptible to damage from severe weather and/or damage from large waves. The retractable bow manifold may be moved from the protected position into a transfer position in preparation for transfer operations and may remain in the transfer position during transfer operations.

Further modifications and alternative embodiments of various aspects of the invention may be apparent to those skilled in the art in view of this description. Accordingly, this description is to be construed as illustrative only and is for the purpose or teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description or the invention. Changes may be made in the elements described herein without departing from the spirit and scope of the invention as described in the following claims. In addition, it is to be understood that features described herein independently may, in certain embodiments, be combined.

The invention claimed is:

1. A retractable liquefied natural gas (LNG) cargo transfer system comprising:

a marine vessel:

an LNG cargo transfer bow manifold moveably attached to a main deck of the marine vessel, wherein the LNG cargo transfer bow manifold is slideable between;

a forward position proximate a bow of the marine vessel; and an aft position aft of the bow;

the LNG cargo transfer bow manifold elevationally coupled to the main deck by a retractable support member, wherein the retractable support member is moveable between:

an extended position such that the LNG cargo transfer bow manifold is raised above the main deck; and a retracted position such that the LNG cargo transfer bow manifold rests on one of the main deck, below the main deck or a combination thereof;

wherein the forward position, together with the extended position, arranges the LNG cargo transfer bow manifold into a cargo transfer position, and wherein the aft position, together with the retracted position, arranges the LNG cargo transfer bow manifold into a stowed position.

2. The retractable LNG cargo transfer system of claim 1, wherein the LNG cargo transfer bow manifold further comprises a removable cargo transfer conduit fluidly coupling the marine vessel and a second marine vessel when the LNG cargo transfer bow manifold is in the cargo transfer position.

3. The retractable LNG cargo transfer system of claim 2, wherein LNG cargo transfer bow manifold further comprises detachable piping fluidly coupling the LNG cargo transfer bow manifold to an LNG cargo tank onboard the marine vessel when the LNG cargo transfer bow manifold is in the cargo transfer position.

4. The retractable LNG cargo transfer system of claim 3, wherein the cargo transfer conduit and the piping are disconnected from the LNG cargo transfer bow manifold when the LNG cargo transfer bow manifold is in the stowed position.

5. The retractable LNG cargo transfer system of claim 1, further comprising a manifold deck coupled between the retractable support member and the LNG cargo transfer bow manifold.

6. The retractable LNG cargo transfer system of claim 5, wherein the manifold deck rests on the main deck in the stowed position.

7. The retractable LNG cargo transfer system of claim 5, wherein the manifold deck rests within a hull of the marine vessel in the stowed position.

8. The retractable LNG cargo transfer system of claim 7, further comprising an actuateable barrier, wherein the actuateable barrier closes over the LNG cargo transfer bow manifold in the stowed position.

9. The retractable LNG cargo transfer system of claim 5, wherein the manifold deck comprises a railing member and the LNG cargo transfer bow manifold is slideable between the forward position and the aft position along the railing member.

10. The retractable LNG cargo transfer system of claim 9, wherein the railing member protrudes from an upper surface of the manifold deck.

11. The retractable LNG cargo transfer system of claim 1, further comprising a breakwater extending around a periphery of the main deck at the bow.

12. A method for tandem marine liquefied natural gas (LNG) cargo transfers comprising:

positioning a first marine vessel at a ship to ship (STS) transfer location in tandem with a second marine vessel;

sliding an LNG cargo transfer bow manifold onboard the first marine vessel forward along a track to about a bow of the first marine vessel;

extending an LNG cargo transfer bow manifold support member to bring the LNG cargo transfer bow manifold above a main deck of the first marine vessel;

coupling an LNG transfer conduit to the LNG cargo transfer bow manifold on a first side and to the second marine vessel on a second side at the STS transfer location;

connecting LNG piping to the LNG cargo transfer bow manifold on a first coupled side of the LNG piping and an LNG cargo tank onboard the first marine vessel on a second coupled side of the LNG piping at the STS transfer location;

transferring LNG between the first marine vessel and the second marine using the LNG cargo transfer bow manifold; and returning the LNG cargo transfer bow manifold to a protected position onboard the first marine vessel prior to departing the STS transfer location.

13. The method of claim 12, wherein returning the LNG cargo transfer bow manifold to a protected position comprises:

disconnecting the LNG piping from the LNG cargo transfer bow manifold and the LNG cargo tank;

sliding the LNG cargo transfer bow manifold aft along a track away from the bow of the first marine vessel; and retracting an LNG cargo transfer bow manifold support member to bring the LNG cargo transfer bow manifold onto the main deck of the first marine vessel.

14. The method of claim 12, wherein the protected position is at least partially in a hull of the first marine vessel.

15. The method of claim 14, further comprising closing a barrier over the LNG cargo transfer bow manifold once the LNG cargo transfer bow manifold is in the protected position.

16. The method of claim 12, wherein the first marine vessel receives LNG from the second marine vessel during the LNG transfer and stores the received LNG in the LNG cargo tank.

17. The method of claim 12, wherein the first marine vessel offloads LNG to the second marine vessel during the LNG transfer.

18. The method of claim 12, wherein extending the LNG cargo transfer bow manifold support member comprises raising the LNG cargo transfer bow manifold over a breakwater.

19. A liquefied natural gas (LNG) cargo transfer system comprising:

a first LNG carrier vessel comprising a protected location within a hull of the first LNG carrier vessel and below a main deck;

an LNG cargo transfer bow manifold slideably coupled to the protected location, wherein the LNG cargo transfer bow manifold is slideable between:

a protected position at the protected location; and an LNG transfer position forward of a bow of the marine vessel and at least partially outside the hull;

an actuateable shield at the bow, wherein the actuateable shield closes the protected location when the LNG cargo transfer bow manifold is in the protected position and opens to allow the LNG cargo transfer bow manifold to slide to the LNG transfer position;

a removable LNG transfer conduit fluidly coupling the first LNG carrier vessel and a second LNG carrier vessel when the LNG cargo transfer bow manifold is in the LNG transfer position; and detachable piping fluidly coupling the LNG cargo transfer bow manifold to an LNG cargo tank onboard the first LNG carrier vessel when the LNG cargo transfer bow manifold is in the LNG transfer position.

* * * * *